US011105088B2

(12) United States Patent
Binder

(10) Patent No.: US 11,105,088 B2
(45) Date of Patent: Aug. 31, 2021

(54) MODULAR SYSTEM FOR CREATING A STRUCTURE, MODULE CONNECTOR AND STRUCTURE COMPRISING A MODULAR SYSTEM

(71) Applicant: KNAUF GIPS KG, Iphofen (DE)

(72) Inventor: Joachim Binder, Purbach (DE)

(73) Assignee: KNAUF GIPS KG, Iphofen (DE)

( * ) Notice: Subject to any disclaimer, the term of this patent is extended or adjusted under 35 U.S.C. 154(b) by 0 days.

(21) Appl. No.: 16/638,994

(22) PCT Filed: Aug. 7, 2018

(86) PCT No.: PCT/EP2018/000392

§ 371 (c)(1),
(2) Date: Feb. 13, 2020

(87) PCT Pub. No.: WO2019/034279

PCT Pub. Date: Feb. 21, 2019

(65) Prior Publication Data

US 2020/0199863 A1 Jun. 25, 2020

(30) Foreign Application Priority Data

Aug. 18, 2017 (WO) ..... PCT/EP2017/000997

(51) Int. Cl.
*E04B 1/348* (2006.01)
*E04C 3/07* (2006.01)
(Continued)

(52) U.S. Cl.
CPC ..... *E04B 1/3483* (2013.01); *E04B 1/40* (2013.01); *E04C 3/07* (2013.01); *E04C 3/32* (2013.01);
(Continued)

(58) Field of Classification Search
CPC .. E04B 1/3483; E04B 1/40; E04B 2001/2406; E04B 1/34336; E04B 1/34331;
(Continued)

(56) References Cited

U.S. PATENT DOCUMENTS 3,083,670 A 4/1963 Harlander et al.
3,559,357 A * 2/1971 Lowe ..... E04B 2/56 52/282.4

(Continued)

FOREIGN PATENT DOCUMENTS

EP 0267843 5/1988
EP 1055036 9/2002

(Continued)

OTHER PUBLICATIONS

International Preliminary Report on Patentability for International (PCT) Application No. PCT/EP2018/000392, dated Feb. 18, 2020, 8 pages.

(Continued)

*Primary Examiner* — Theodore V Adamos
(74) *Attorney, Agent, or Firm* — Sheridan Ross P.C.

(57) ABSTRACT

Modular system for creating a structure, in particular a building component, comprising at least one post profile (2), at least one ceiling profile (3) and at least one floor profile (4) for a basic framework of a first modular unit (50, 50', 50'', 50'''), at least one further post profile (2), at least one further ceiling profile (3) and at least one further floor profile (4) for a basic framework of a second modular unit (50, 50', 50'', 50'''), and a module connector (38) for connecting the first and the second modular unit (50, 50', 50'', 50'''), wherein the post profile (2) has a first pin holding fixture (55) and the further post profile (2) has a second pin holding fixture (55), wherein the module connector (38) has a first connecting pin (39) for insertion into the first pin holding
(Continued)

fixture (55) and a second connecting pin (40) for insertion into the second pin holding fixture (55), and wherein the module connector (38) has a supporting element (41) on which the first and second connecting pins (39, 40) are arranged.

21 Claims, 15 Drawing Sheets

(51) Int. Cl.
*E04C 3/32* (2006.01)
*E04B 1/41* (2006.01)
*E04C 3/04* (2006.01)

(52) U.S. Cl.
CPC *E04C 2003/043* (2013.01); *E04C 2003/0421* (2013.01); *E04C 2003/0439* (2013.01); *E04C 2003/0452* (2013.01); *E04C 2003/0465* (2013.01)

(58) Field of Classification Search
CPC ..... E04C 3/07; E04C 3/32; E04C 2003/0421; E04C 2003/043; E04C 2003/0452; E04C 2003/0465; E04C 2003/0439; E04H 1/005; E04H 2001/1283
See application file for complete search history.

(56) References Cited

U.S. PATENT DOCUMENTS 3,717,964 A 2/1973 Brown et al.
3,752,511 A * 8/1973 Racy ..... F16B 21/02 24/287
3,822,519 A * 7/1974 Antoniou ..... E04B 1/3483 52/79.13
3,824,750 A * 7/1974 Antoniou ..... E04B 1/34815 52/79.13
4,069,638 A * 1/1978 Hasselqvist ..... B21C 37/104 403/231
4,599,829 A * 7/1986 DiMartino, Sr. ..... E04B 1/3483 410/79
4,708,252 A * 11/1987 Azzi ..... A47B 57/04 108/108
4,712,286 A * 12/1987 Wolf ..... A47B 57/40 138/160
5,291,716 A * 3/1994 Broberg ..... E04B 1/3483 52/745.03
6,363,586 B1 * 4/2002 Neufingerl ..... B65D 88/005 220/1.5
9,476,441 B2 * 10/2016 Strassle ..... F16B 7/0446
2007/0271857 A1 * 11/2007 Heather ..... B65D 90/0026 52/79.9
2013/0305629 A1 * 11/2013 Stephenson ..... E04B 1/3483 52/79.9
2014/0130441 A1 * 5/2014 Sugihara ..... E04B 1/2403 52/656.9
2015/0159363 A1 * 6/2015 Ehsasi ..... E04H 1/06 52/79.5
2017/0033753 A1 2/2017 Bowron
2017/0044753 A1 2/2017 Bowron
2018/0127967 A1 5/2018 Bowron
2018/0127982 A1 * 5/2018 Lemiegre ..... E04F 10/10
2020/0190788 A1 6/2020 Binder

FOREIGN PATENT DOCUMENTS

EP 2674538 12/2013
GB 1350631 4/1974
KR 101320774 B1 * 10/2013 ..... E04B 1/3483
NL 6906946 11/1970
RU 2120002 10/1995
RU 86634 9/2009
WO WO-0009827 A1 * 2/2000 ..... E04B 1/3483
WO WO 2013/177920 12/2013
WO WO 2015/164975 11/2015
WO WO 2016/176915 11/2016

OTHER PUBLICATIONS

Search Report for Russian Patent Application No. 2020106401/03, dated Sep. 15, 2020, 3 pages.
International Search Report and Written Opinion for International (PCT) Patent Application No. PCT/EP2018/000392, dated Nov. 23, 2018, 11 pages.
International Search Report and Written Opinion for International (PCT) Patent Application No. PCT/EP2017/000997, dated May 7, 2018, 11 pages.
International Preliminary Report on Patentability for International (PCT) Application No. PCT/EP2017/000997, dated Feb. 18, 2020, 8 pages.

* cited by examiner

MODULAR SYSTEM FOR CREATING A STRUCTURE, MODULE CONNECTOR AND STRUCTURE COMPRISING A MODULAR SYSTEM

CROSS REFERENCE TO RELATED APPLICATIONS

This application is a national stage application under 35 U.S.C. 371 and claims the benefit of PCT Application No. PCT/EP2018/000392 having an international filing date of 07 Aug. 2018, which designated the United States, which PCT application claimed the benefit of International Application No. PCT/EP2017/000997 filed 18 Aug. 2017, the disclosures of each of which are incorporated herein by reference.

The invention relates to a modular system for creating a structure, in particular a building component, comprising at least one post profile, at least one ceiling profile and at least one floor profile for a basic framework of a first modular unit, at least one further post profile, at least one further ceiling profile and at least one further floor profile for a basic framework of a second modular unit, and a module connector for connecting the first and the second modular unit. The invention further relates to a structure, in particular a building component, comprising the modular system as well as a module connector for such modular system.

EP 1 055 036 B1 describes a modular system for creating a building component, which has a basic framework comprising post profiles, ceiling profiles and floor profiles. It describes that two adjacent modules can be interconnected.

A further previously known modular system for creating a building component is known from EP 2 674 538 A1.

The aim of modular construction is to prefabricate parts of a structure, in particular room units, as modular units, and to assemble these modular units on the building site. However, the previously known modular systems are highly complex to assemble.

The object of the invention is to specify a modular system for creating a structure, a module connector, and a structure which can be set up in a particularly simple and reliable manner.

With regard to the modular system for creating a structure, in particular a building component, this object is achieved by the features of claim 1. Accordingly, the system mentioned at the outset is characterised by the post profile having a first pin holding fixture and the further post profile having a second pin holding fixture, and a module connector which has a first connecting pin for insertion into the first pin holding fixture and a second connecting pin for insertion into the second pin holding fixture, and in that the module connector has a supporting element on which the first and the second connecting pin are arranged. This configuration makes the assembly of the structure particularly simple and reliable. In particular, with the module connector according to the invention, reliable and rapid connection of the modules can be achieved on site. In this context, the modules can be connected using a plug-in connection which can be assembled without tools. A reliable plug-in connection is already achieved if the first connecting pin is inserted into the first pin holding fixture and the second connecting pin is inserted into the second pin holding fixture. The described connection of the modules is particularly advantageous, if the modules are prefabricated and merely have to be joined together on the building site. The first and the second module may be arranged side by side or above one another. The structure is preferably a building component. However, the modular system is moreover also suitable for other structures, for example the superstructure of a ship. Preferably, the pin holding fixtures are formed as guides for the connecting pins. The modular units may in particular be formed as room units. A room unit preferably forms a room of a building, such as a lounge, living room, office, storage room or the like. A room unit may have a ceiling, a floor and open or closed walls. A room unit comprises at least three post profiles. Preferably, a room unit comprises four post profiles, which are arranged at the corners of the room unit.

The object of the invention is also achieved by a structure having the features of claim 15. Accordingly, the first modular unit and the second modular unit are connected using the module connector in that the first connecting pin is inserted into the first pin holding fixture and the second connecting pin is inserted into the second pin holding fixture.

The object of the invention is also achieved by a module connector having the features of claim 16. Accordingly, the module connector is formed to connect a first and a second modular unit of a modular system, whereas the module connector has a supporting element, which at least has a first connecting pin and a second connecting pin, whereas the first and the second connecting pin are formed to be inserted into a first and a second pin holding fixture of a first and a second post profile. The first and the second post profile are part of individual modular units.

Hereinafter, additional features of the invention are described. The mentioned features relate to the modular system for creating a structure, the module connector, and to the structure created from the modular system.

The modular system may further comprise correspondingly formed modular units in addition to the first and second modular unit. In this way, relatively large structures, up to and including multi-floor buildings, which comprise a plurality of modular units arranged side by side and/or modular units arranged on the top of one another in two or more storeys, can be implemented using the modular system. References made hereinafter to modular units arranged side by side do not exclude the possibility that according to the invention further modular units may be provided in one or more further storeys of the structure. Equally, references made hereinafter to modular units arranged above one another do not exclude the provision of further modular units of the structure arranged beside them.

According to one advantageous embodiment of the invention the module connector and the first and the second pin holding fixture are formed such that interstices are formed between the post profile and the further post profile when the first modular unit is arranged adjacent to the second modular unit. Thus, the assembly is simplified. In addition, due to the sound insulating characteristic of the interstices better sound insulation between the modular units is achieved. This applies to an arrangement of the modular units both side by side and above one another.

According to a further advantageous embodiment the supporting element is plate-shaped and has a first plate face and a second plate face opposite the first plate face. Preferably, the first and the second connecting pin are arranged on the supporting element; e.g., they are mounted to the supporting element.

According to a particularly advantageous embodiment of the invention the first and the second connecting pin are arranged side by side on the first plate face. Preferably, the first and the second connecting pin are arranged parallel to each other. This embodiment is suitable in particular for a structure in which the first and the second modular unit are arranged side by side.

A further preferred embodiment provides that the first connecting pin is arranged on the first plate face and the second connecting pin is arranged on the second plate face. This embodiment is suitable in particular for a multi-floor construction, in which the first and the second modular unit are arranged one above the other. Preferably, the first and the second connecting pin are arranged coaxially. The first and the second connecting pin may also be made of a single piece.

According to another preferred development of the invention the module connector has further connecting pins. For example, in addition to the first and the second connecting pin provided on the first plate face, the module connector may have two further connecting pins on the first plate face; in this case it is suitable in particular for connecting four modules arranged side by side. Further connecting pins may also be provided on the second plate face; in this case the module connector is suitable for connecting modular units arranged above one another. If four further connecting pins are provided on the second plate face, four modular units can be arranged side by side in a lower plane and four modular units can be arranged above them and all modular units may be reliably connected.

A further improvement provides that the module connector has a mandrel which extends through an opening in the supporting element. A first section of the mandrel forms the first connecting pin and a second section forms a second connecting pin. Particularly simple assembly and good force transmission are achieved, if the external diameter of the first section is greater than an external diameter of the second section, in such a way that the mandrel has a shoulder which is positioned against the supporting element.

The present description describes further features of the modular system. Herein, it may in summary be referred to "connecting pins", if features of the first connecting pin, the second connecting pin and/or possible further connecting pins are concerned. The same applies to the term "post profile", if features of the first post profile, the second post profile, and/or possible further post profiles are concerned.

Preferably, at least one of the connecting pins has at least one cylindrical section.

A further improvement is achieved if at least one of the connecting pins has a hole which extends at an angle, preferably perpendicular, to a longitudinal axis of the at least one connecting pin. A locking means, such as a locking pin or a locking screw, can be inserted into the hole in order to retain the locking pin in the pin holding fixture.

A particularly preferred embodiment provides that a sound insulation element is joined to the supporting element. Preferably, the sound insulation element is made of a plastic material. The sound insulation element may preferably form a cover for at least one of the connecting pins. Further, the sound insulation element may have a plate-shaped section which extends in parallel to the plate-shaped supporting element. The sound insulation element facilitates the assembly of the structure. In addition, it can prevent direct contact between the supporting element and the post profile or further post profiles, and thus improve the sound-insulating properties.

The post profile and the further post profile are preferably shaped identically. Features of the post profile described herein also apply to the further post profiles. The ceiling profile and the further ceiling profile are preferably shaped identically. Features of the ceiling profile described herein also apply to the further ceiling profiles. The floor profile and the further floor profile are preferably shaped identically. Features of the floor profile described herein also apply to the further floor profiles. In addition, the structure may comprise a plurality of the module connectors.

Advantageously, the first modular unit and/or the second modular unit each can have a basic framework comprising a frame, in particular a wall frame, which each comprises two of the post profiles, the upper ends and the lower ends of which are interconnectable or (in the assembled state) interconnected via the ceiling profile and the floor profile, respectively.

A further improvement provides that the post profile, the ceiling profile and the floor profile each have differently configured cross-sections. Preferably, the basic framework is self-supporting. Preferably, the elongate post profiles are arranged vertically in the assembled state. It is further preferred if the elongate ceiling profiles and the elongate floor profiles are arranged horizontally and fastened to the post profiles in the assembled state.

According to a preferred development the post profile and/or the ceiling profile and/or the floor profile comprise a shaped metal sheet. This contributes to a high stability and low production costs.

Preferably, the post profile has at least one slot guide extending in its longitudinal direction. Preferably, the at least one slot guide extends in the longitudinal direction of the post profile over the entire length of said profile. The slot guide is preferably shaped as a dovetail guide. The slot guide may be formed integrally in the post profile. A particularly preferred embodiment provides that the post profile has two slot guides having opening directions orientated substantially mutually perpendicular to one another. The slot guides contribute to a high stability of the profile.

A connecting element is arrangeable or arranged in the at least one slot guide so as to connect a ceiling profile and/or a floor profile to the post profile. Preferably, the connecting element is formed as a connecting strap.

According to a preferred embodiment the slot guide has a notch for positive connection to hooks of the connecting element.

Preferably, the post profile has four sides, arranged mutually at an angle. Preferably, this results in a basic shape of substantially a square cross-section. This does not exclude the possibility that for example the described slot guides are arranged in some of the sides.

The post profile and/or the ceiling profile and/or the floor profile can preferably be formed as a hollow profile which encloses at least one cavity. Preferably, all aforementioned profiles are at least partially formed as hollow profiles. This contributes to a simple handling, low costs and to high stability.

According to a particularly preferred embodiment, the first and the second pin holding fixture each comprise sections of two sides of the post profile, which are arranged at an angle, in particular perpendicular, to one another. Preferably, the hollow post profile comprises the respective pin holding fixture in the cavity formed by the post profile. The inner faces of the two angularly arranged sides of the post profile can each form a contact face for one of the connecting pins. It is further preferred if the two sides of the post profile, which are configured to contact the connecting pin, are not the sides of the post profile which comprise the slot guides.

The system comprises at least one connecting element for fastening the ceiling profile and/or the floor profile to the post profile. Preferably, connecting elements are arranged at each end of the ceiling profile and of the floor profile. The connecting element may be arranged in the slot guide of the post profile. It may additionally have fastening means, in particular hooks, which are inserted into notches provided in the base of the slot guide. The fastening means, in particular hooks, protrude into the interior of the hollow post profile. In this context, the pin holding fixture can comprise a section of the connecting element (in particular of the fastening means). In this way, the pin holding fixture in which the connecting pin is received can be formed by the connecting element and the two sides of the post profile which are arranged at an angle to one another. Preferably, in each of the slot guides at least one connecting element is received, a section of which protrudes into the associated post profile and which together with two sides of the associated post profile forms the pin holding fixture.

According to a particularly preferred embodiment the ceiling profile comprises a crosspiece which connects a first and a second hollow profile section. The first and/or the second hollow profile section can be formed as a box profile. They may in particular have four side walls arranged substantially mutually perpendicular.

It is further preferred for the floor profile to comprise a crosspiece, which connects a first and a second hollow profile section of the floor profile. Preferably, the first and/or the second hollow profile section of the floor profile are formed as a box profile. They may in particular have four side walls, wherein adjacent sidewalls are arranged at right angles to one another.

Preferably, the ceiling profile comprises a shaped metal sheet, the crosspiece being formed by two side-by-side, mutually touching sections of the metal sheet.

Preferably, the floor profile comprises a shaped metal sheet, the crosspiece being formed by two side-by-side, mutually touching sections of the metal sheet.

It is further preferred for the first hollow profile section of the ceiling profile and/or of the floor profile to be formed by a closed, continuous region of the shaped metal sheet.

A further preferred configuration provides that in the second hollow profile section of the ceiling profile and/or of the floor profile the ends of the metal sheet are arranged edge to edge. Preferably, in the region of the ends thereof the metal sheet has regions which are folded back on themselves.

Preferably, the post profile and/or the ceiling profile and/or the floor profile are made of steel.

According to a particularly preferred embodiment the first modular unit and/or the second modular unit each comprise at least one wall. The wall may in particular have support elements on which a planking is arranged. The support elements may be metal support profiles, in particular dry-construction profiles, such as U- or C-profiles. The planking preferably comprises boards arranged on both sides of the support elements and fastened thereto. An insulating material may be arranged between the boards. The planking preferably comprises building boards. For interior planking gypsum boards, especially plasterboards are preferred. Preferably, one module has four walls arranged mutually perpendicular. The support elements are preferably connected to the ceiling profile by a first end and to the floor profile by a second end. The walls may have openings, for example for windows or doors.

It is further preferred for the first modular unit and/or the second modular unit each to comprise at least one ceiling. The ceiling may in particular have support elements on which a planking is arranged. The support elements may be metal support profiles, in particular dry-construction profiles, such as U- or C-profiles. The planking preferably comprises building boards, which are arranged on one or both sides of the support elements. An insulating material may be arranged between the building boards. The planking preferably comprises gypsum based boards, especially plasterboards or gypsum fibre boards. The support elements are preferably connected to a ceiling profile by a first end and to a further ceiling profile by a second end.

A preferred embodiment provides that the first modular unit and/or the second modular unit each have at least one floor. The floor may in particular have support elements on which a planking is arranged. The support elements may be metal support elements, such as U- or C-profiles. The planking of the floor comprises building boards arranged on the upper face of the support elements. The planking may preferably be constructed multi-layered. Preferably, the planking comprises dry screed boards and a floor covering arranged thereon. Moreover, sound insulation material may be arranged below the dry screed boards. Preferably, the planking additionally comprises boards arranged on the lower face of the support elements. An insulating material may be arranged between the plates. The planking preferably comprises gypsum based boards, especially plasterboards or gypsum fibre boards.

The module connector preferably consists of metal, in particular of steel.

According to the invention, the first basic framework, comprising the at least one post profile, the at least one ceiling profile and the at least one floor profile, can be assembled to form the first modular unit, and the second basic framework, comprising the at least one further post profile, the at least one further ceiling profile and the at least one further floor profile, can assembled to form the second modular unit.

The first modular unit and the second modular unit can be connected by the module connector by inserting the first connecting pin into the first pin holding fixture and the second connecting pin into the second pin holding fixture.

The presently described invention explicitly comprises a modular system for a structure as described, but without the module connectors, even if this is originally not claimed.

Further aims, features, advantages and possible applications of the present invention will be apparent from the following description of embodiments with reference to the drawings. All features described and/or visually portrayed, in their own right or in any reasonable combination, form the subject matter of the invention, regardless of how they are combined in individual claims or the dependencies thereof.

Figure 3:
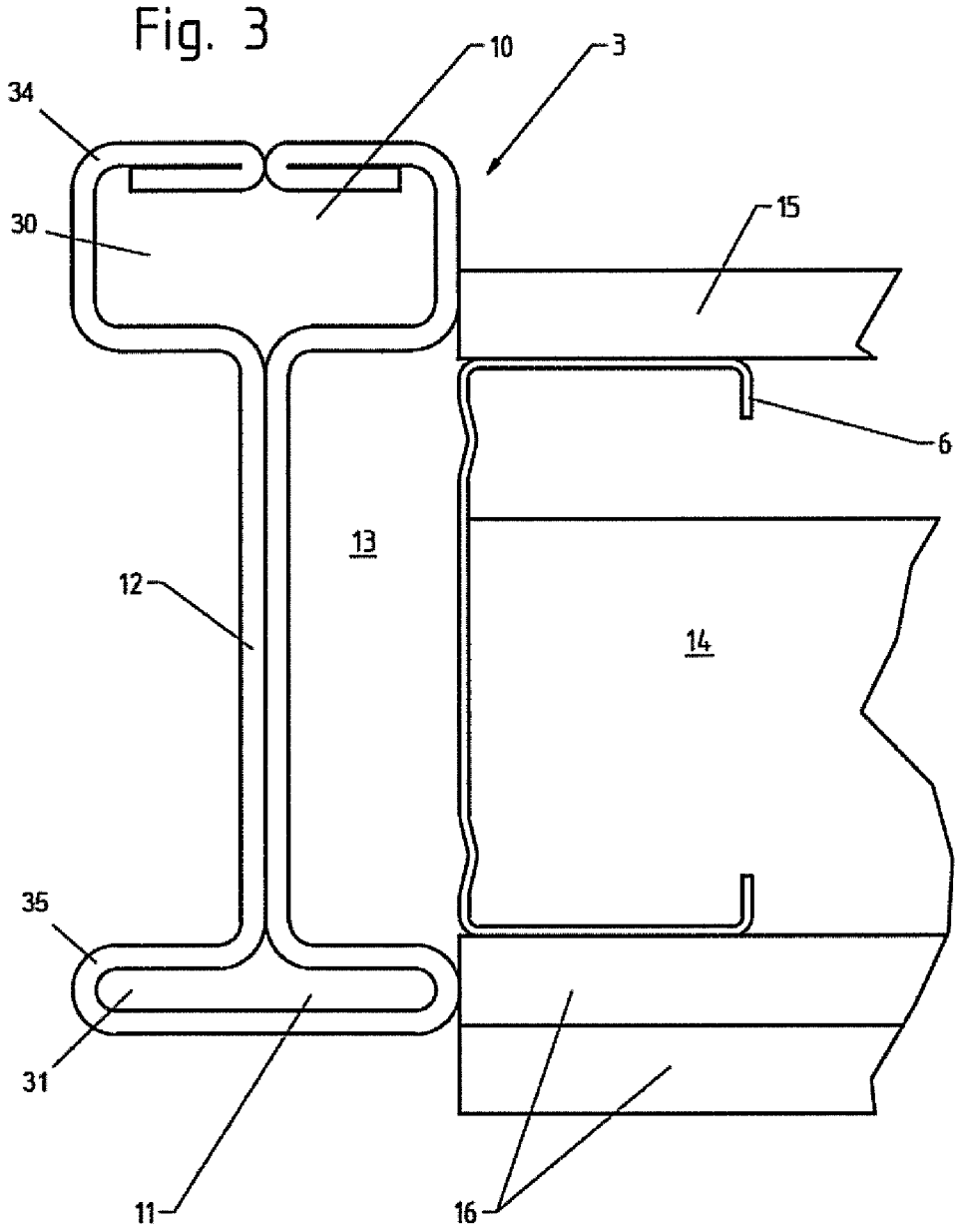
FIG. 3 is a cross-section of a ceiling profile for a frame according to FIG. 1 and a detail of a ceiling.
Figure 4:
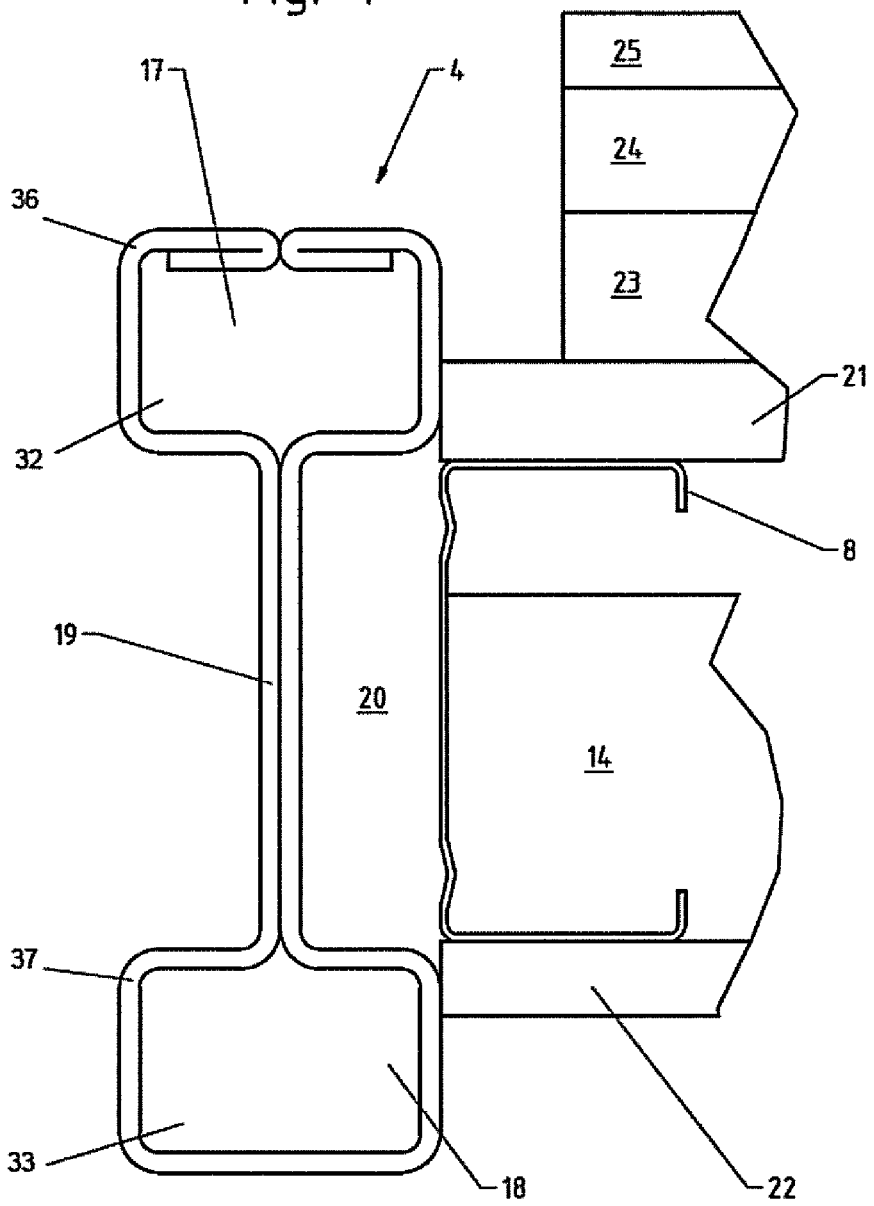
FIG. 4 is a cross-section of a floor profile for a frame according to FIG. 1 and a detail of a floor.
Figure 7A:
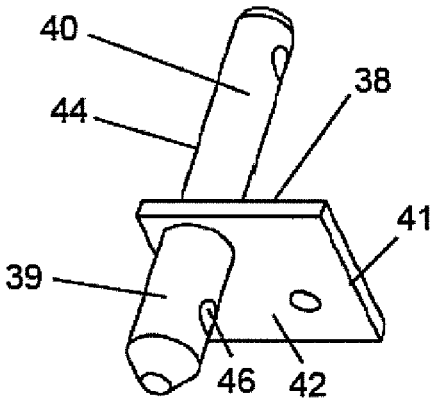
Figure 7B:
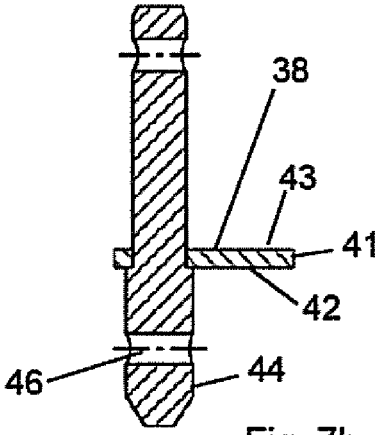
Figure 8A:
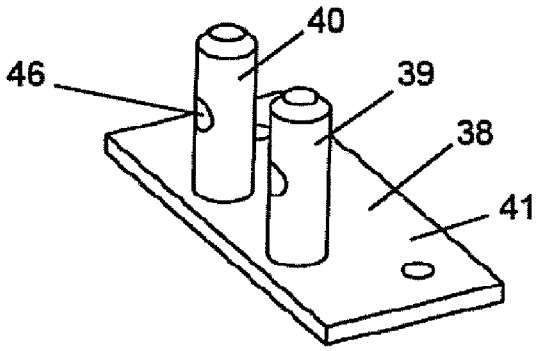
Figure 8B:
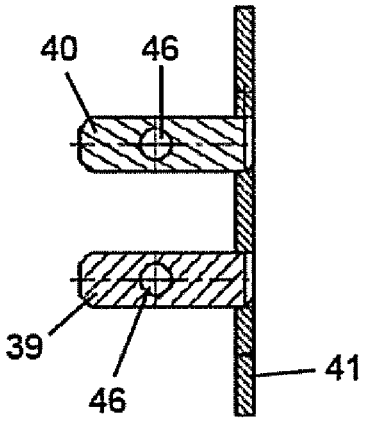
Figure 9A:
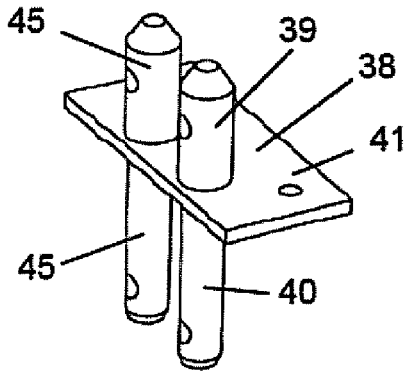
Figure 9B:
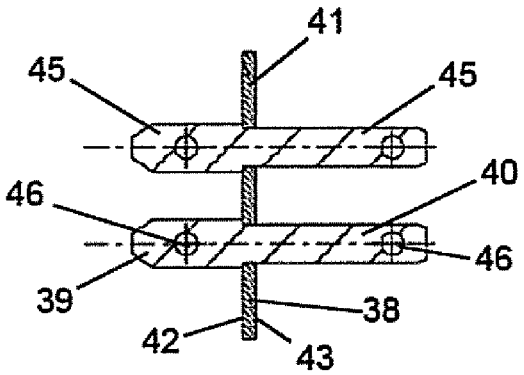
Figure 10A:
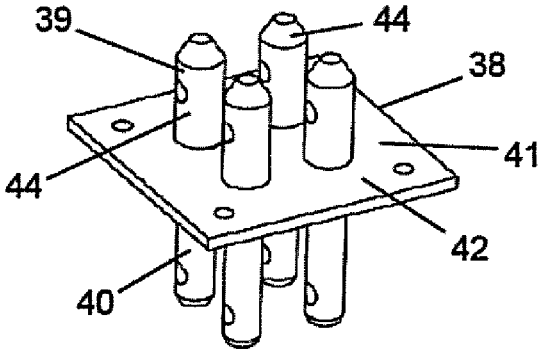
Figure 10B:
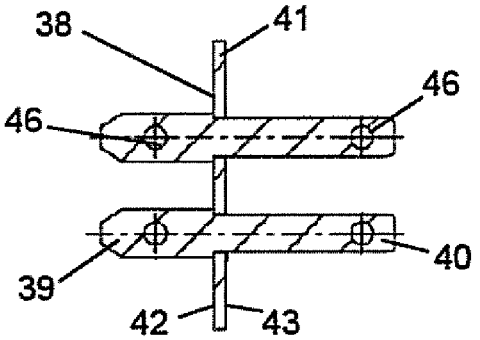
Figure 11A:
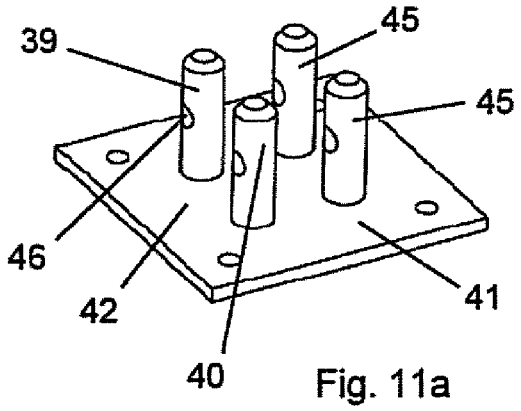
Figure 11B:
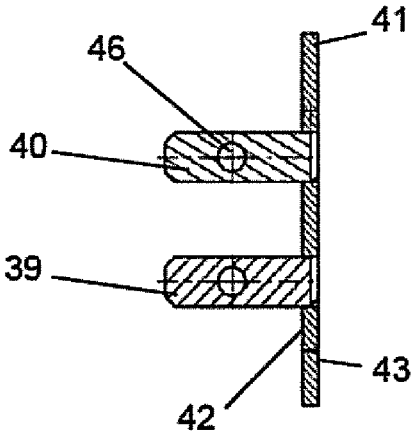
Figure 12:
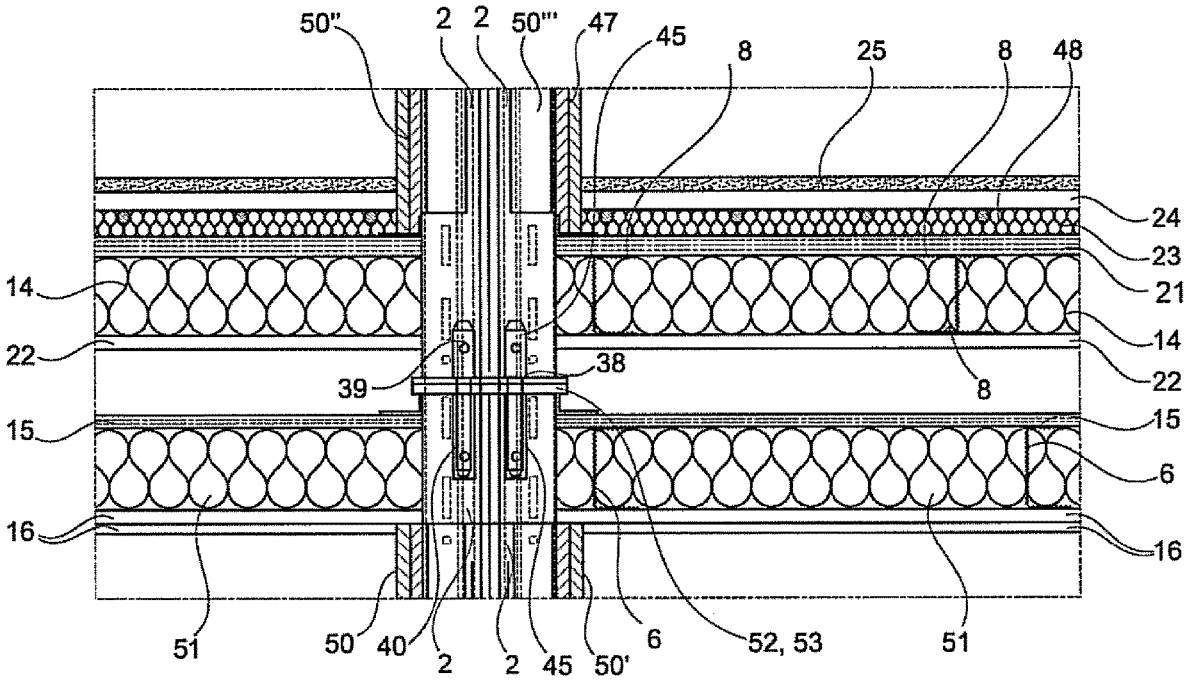
Figure 13:
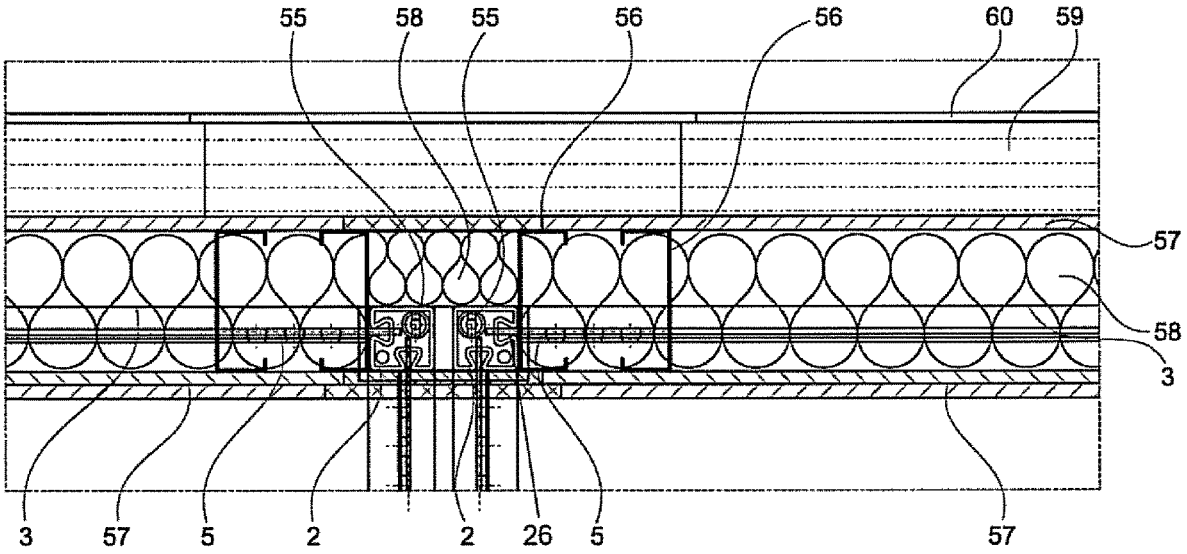
Figure 14:
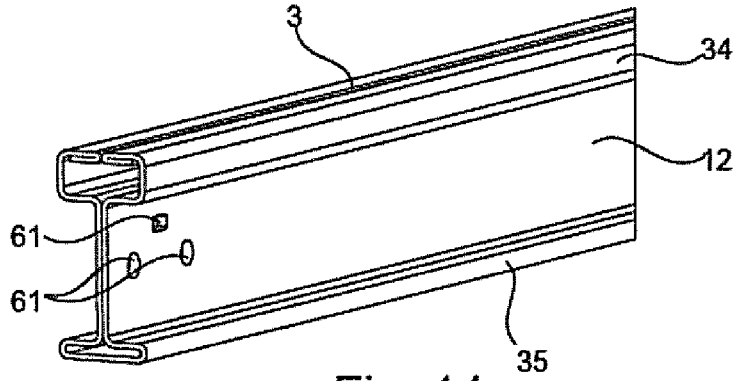
Figure 15:
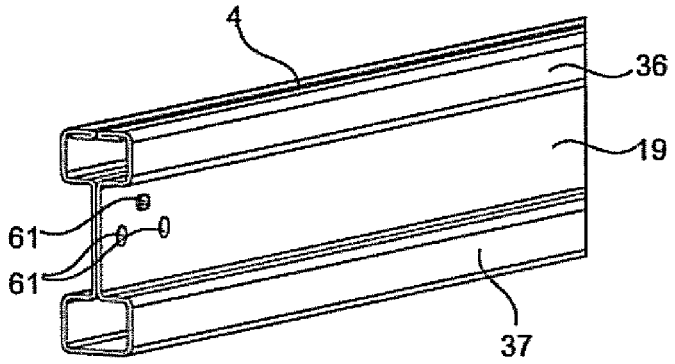
Figure 16:
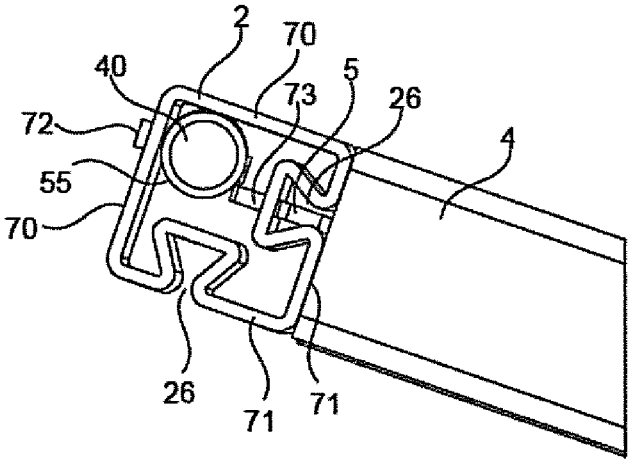
Figure 17:
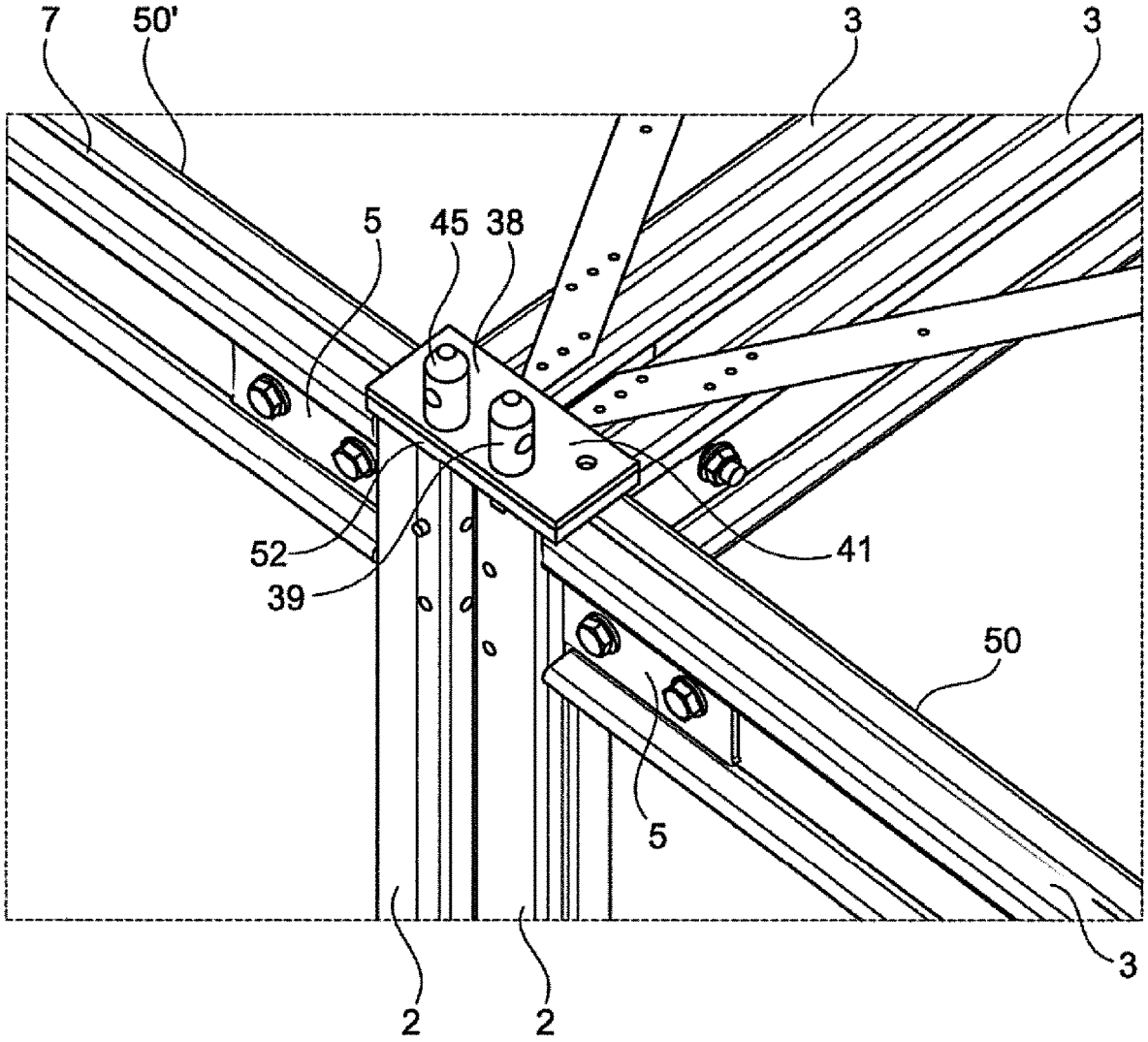

FIG. 7*a*, 7*b* are a perspective view and a longitudinal section of a module connector in accordance with a first embodiment;

FIG. 8*a*, 8*b* are a perspective view and a longitudinal section of a module connector in accordance with a second embodiment;

FIG. 9*a*, 9*b* are a perspective view and a longitudinal section of a module connector in accordance with a third embodiment;

FIG. 10*a*, 10*b* are a perspective view and a longitudinal section of a module connector in accordance with a fourth embodiment;

FIG. 11*a*, 11*b* are a perspective view and a longitudinal section of a module connector in accordance with a fifth embodiment;

FIG. 12 is a schematic cross-section of a part of a structure comprising four modular units from the side;

FIG. 13 is a schematic cross-section of a part of the two of the modular units of FIG. 12 from above;

FIG. 14 is a perspective view of a section of the ceiling profile of FIG. 3;

FIG. 15 is a perspective view of a section of the floor profile of FIG. 4;

FIG. 16, 16*a* are a partial view from the bottom and a side view of the post profile, which is connected to a floor profile;

FIG. 17 is a perspective top view of two modular units, which are connected by the module connector.

Figure 1:
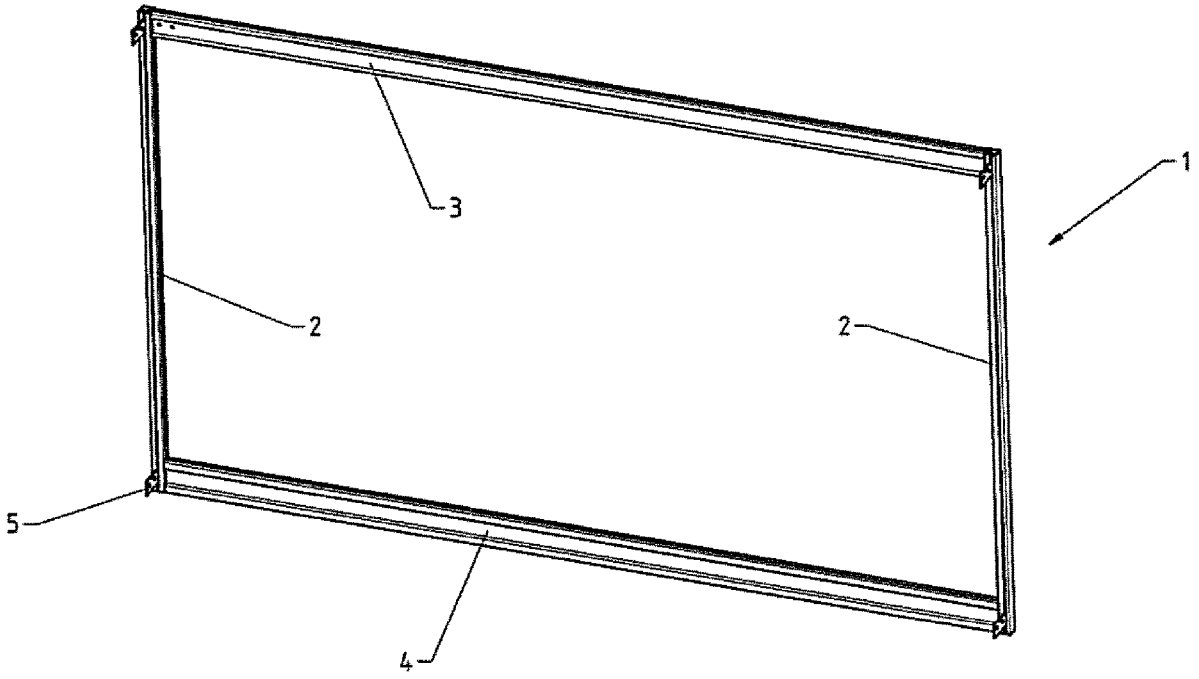
FIG. 1 is a side view of a frame according to the inventions for modular construction.

FIG. 1 is a side view of a frame 1 according to the invention for a modular system for creating a structure. The frame 1 according to the invention comprises two vertical post profiles 2, a horizontal ceiling profile 3 interconnecting the upper ends of the post profiles 2, and a horizontal floor profile 4 interconnecting the lower ends of the post profiles 2.

The frame 1 may substantially form the frame for a wall of a modular unit for a modular construction. At the same time, it may serve as a building block for the structure of a substantially approximately cuboid basic framework for a modular unit of this type, in which case the ceiling profile 3 forms part of the ceiling of the modular unit and the floor profile 4 forms part of the floor of the modular unit.

In the embodiment shown, the post profiles 2 are formed as corner profiles. This allows for the orthogonal attachment of at least a further ceiling and a further floor profile 3, 4 to each of the post profiles 2, thereby adding further walls of the module. The ceiling profiles 3 and floor profiles 4 are each connected to the post profiles 2 via substantially plate-like or strap-shaped, flat connecting elements 5.

Figure 2:
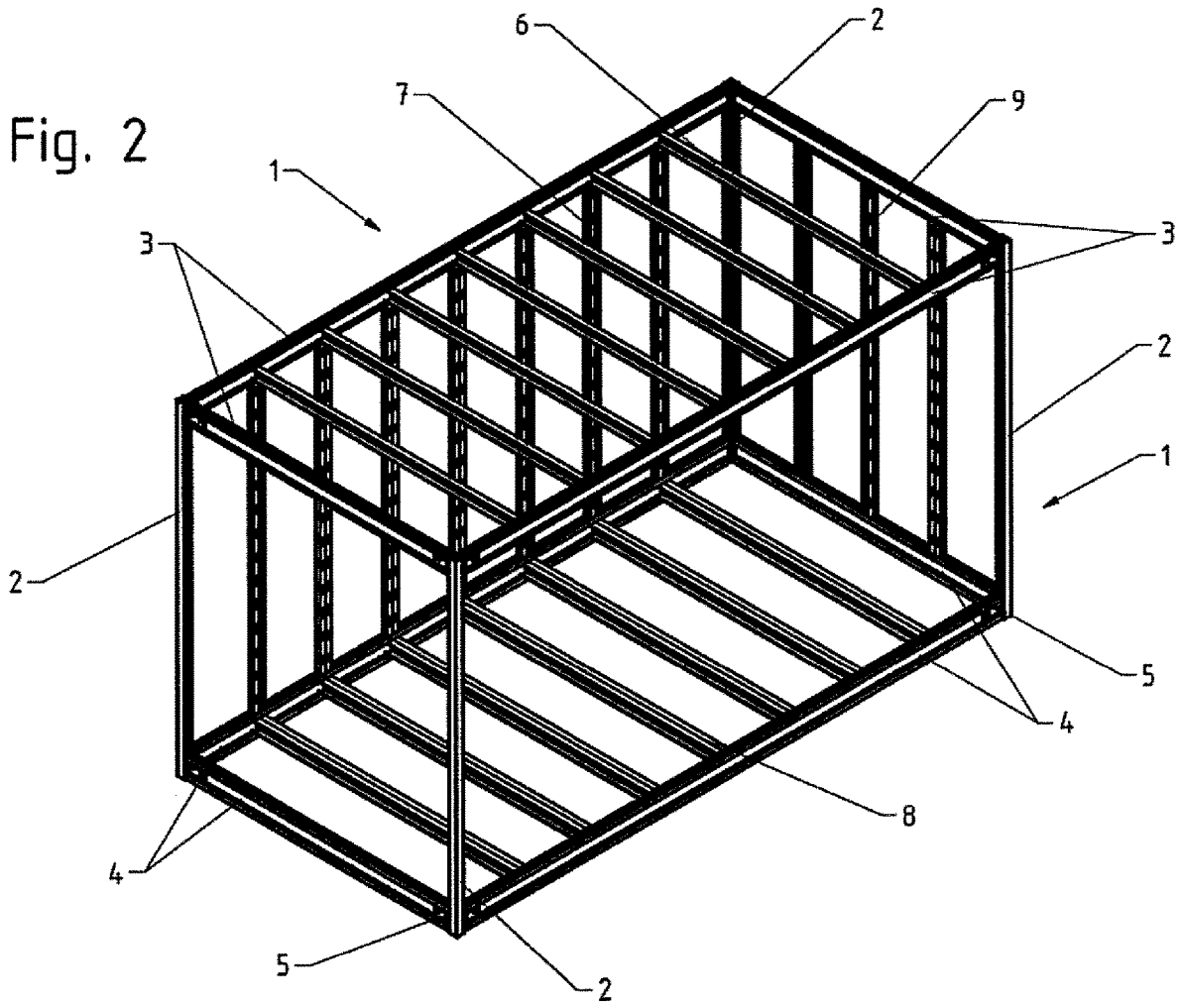
FIG. 2 is a perspective view of a basic framework according to the invention, comprising two frames according to FIG. 1.

FIG. 2 is a perspective view of a basic framework according to the invention for a module for modular construction.

Two frames 1 form each of the longitudinal side frames of this basic framework. As explained previously in connection with FIG. 1, the respective post profiles 2 of this frame 1 are transversely interconnected via further ceiling profiles 3 and floor profiles 4 to form a cuboid shape. However, the end faces of frames 1 which are interconnected longitudinally via ceiling profiles 3 and floor profiles 4 could also be formed, since both the end faces and the longitudinal faces exhibit frames 1 as a result. This makes the basic framework statically particularly stable, overall self-supporting and also able to support a load. Thus, it is also possible to stack many basic frameworks of this type on top of one another and interconnect them to form building storeys; modular construction, even of multi-storey buildings, is possible. Static requirements are still fulfilled if, as shown in FIG. 2, for example a frame 1 is left open, in other words unfilled and a correspondingly mirror-inverted, open basic framework is attached to this open face, so as to provide a continuous space which is twice as large as a room unit formed by one basic framework. Two or more side walls may also be left open, so as to form even larger spaces using a large number of basic frameworks. According to the invention, this is possible because the frame 1 shown in FIG. 1, whether completed to form a wall or not, already provides the desired stability and carrying capacity. The stability and carrying capacity are at least partly the result of the special cross-sectional profile shape of the respective profiles 2, 3, 4, which are discussed in greater detail hereinafter.

As indicated in FIG. 2, the connecting elements 5 are attached to the respective profiles 3, 4 from the outside. For further provision of construction elements for dry-build constructions, dry-construction profiles 6, 7, 8, 9, for example C-profiles, in particular dry-construction profiles of lightweight steel, may be inserted between the frame profiles 2, 3, 4 in the kind of a stud work. The frame profiles 2, 3, 4 are preferably made of sheet steel.

FIG. 3 is a cross-section of a ceiling profile 3 according to the invention for a frame 1 according to FIG. 1. The ceiling profile 3 is formed from a sheet material, preferably from a metal sheet, preferably from a steel sheet. The profile comprises regions of a hollow cross-section. The sheet metal is bent round or angled with corner radii that avoid weaknesses in the corner regions. Additionally, welded connections for further enhancement of the stability of the profile are conceivable and possible in some regions, in particular in the seam region of the profile.

The ceiling profile 3 has substantially a double-T cross-sectional shape. In this context, a hollow thickened head portion 10 and a hollow thickened foot portion 11 are formed. Between these extends the crosspiece 12 of the ceiling profile 3, which is vertically orientated when assembled in the frame 1.

In FIG. 3, beside or against the ceiling profile 3, dry-construction elements for forming a room ceiling for completing a module and for filling the ceiling area of a basic framework according to FIG. 2 are shown. The approximately C-shaped cross-section of a dry-construction profile 6, in particular a lightweight steel profile such as is also shown several times in FIG. 2, is indicated. The end faces of the profile 6 may be inserted as far as the crosspieces 12 in a positive fit into the mounts 13 of profiles 3 oriented perpendicularly to the one shown in FIG. 3. The mounts 13 are formed by the thickened head portions 10, thickened foot portions 11 and crosspieces 12 of ceiling profiles 3. The mounts 13 are approximately U-shaped in cross-section.

In FIG. 3, an insulant layer 14, for example made of mineral wool, is sketched in the profile 6. In addition, the profile 6 is planked on both sides with building boards 15, 16, for example plasterboards. The upper planking 15 is formed single-layered; the lower planking 16, which forms the ceiling surface visible in the space formed by a module, is formed double-layered. The insulant 14, the profile 6 and the planking 15 and 16 and optionally further components also provide for sound protection and/or fire protection.

FIG. 4 is a cross-section of a floor profile 4 according to the invention for a frame 1 shown in FIG. 1.

The floor profile 4 is formed from a sheet material, preferably from a metal sheet, preferably from a steel sheet. The profile has regions with hollow cross-sections. The sheet metal is bent round or angled with corner radii such that weaknesses in the corner regions are avoided. Additionally, welded connections for further enhancing the stability of the profile are conceivable and possible in places, in particular in the seam region of the profile.

The floor profile 4 has substantially a double-T cross-sectional shape. The profile has a hollow thickened head portion 17 and a hollow thickened foot portion 18. Between these extends crosspiece 19 of the ceiling profile 4, which is oriented vertically when arranged in frame 1.

FIGS. 3 and 4 show that the ceiling profile 3 and the floor profile 4 are formed as a hollow profile each. In the embodiment shown, the ceiling profile 3 and the floor profile 4 each have two cavities 30, 31 and 32, 33 respectively. In the ceiling profile 3, the upper cavity 30 is larger than the lower cavity 31. In the floor profile 4, the upper cavity 32 and the lower cavity 33 are of substantially the same size. To form the cavities 30, 31, the ceiling profile 3 has a first hollow profile section 34 and a second hollow profile section 35. The floor profile 4 has a first hollow profile section 36 and a second hollow profile section 37. The crosspiece 12 connects the first and second hollow profile sections 34, 35. The crosspiece 19 connects the first and second hollow profile sections 36, 37. As shown, the first and second hollow profile sections 34 to 37 may each be formed as a box profile having rounded corners. It can clearly be seen from FIGS. 3 and 4 that the first hollow profile section 34 of the ceiling profile 3 and the first and second hollow profile section 36, 37 of the floor profile 4 have profile side walls arranged mutually perpendicular.

FIGS. 3 and 4 further show that the ceiling profile 3 and the floor profile 4 each comprise a shaped metal sheet, the crosspiece 12 or 19 being formed by two side-by-side, mutually touching sections of the metal sheet.

The drawings further show that the second hollow profile sections 35, 37 are each formed by a closed continuous region of the shaped metal sheet. By contrast, in the first hollow profile sections 34 and 36 the ends of the metal sheet are arranged edge to edge. The metal sheet has regions folded back on themselves in the region of the ends thereof.

In FIG. 4, beside or against the floor profile 4, dry-construction elements for forming a room floor for completing a module and for filling the floor area of a basic framework according to FIG. 2 are shown.

The approximately C-shaped cross-section of a dry-construction profile 8, in particular a lightweight steel profile such as is also shown several times in FIG. 2, is indicated. The end faces of the profile 8 may be inserted as far as the crosspieces 19, in a positive fit into the mounts 20 of profiles 4 oriented perpendicularly to the one shown in FIG. 4. The mounts 20 are formed by the thickened head portions 17, thickened foot portions 18 and crosspieces 19 of floor profiles 4. The mounts 20 are approximately U-shaped in cross-section.

In FIG. 4, an insulant layer 14, for example made of mineral wool, is arranged in the profile 8. In addition, the profile 8 is planked on both sides with building boards 21, 22, for example plaster and/or wood-based building boards. Both plankings 21, 22 are formed single-layered. In addition, in the embodiment shown in FIG. 4 the floor has three further layers 23, 24, 25, of which the uppermost layer 25 forms the floor surface visible in the room formed by a module. The insulant 14, the profile 8, the planking 21, 22, the layers 23, 24, 25 and optionally further components can provide for sound protection and/or fire protection.

Side walls of a modular unit may for example be formed and planked in a similar manner to a ceiling according to FIG. 3.

Figure 5:
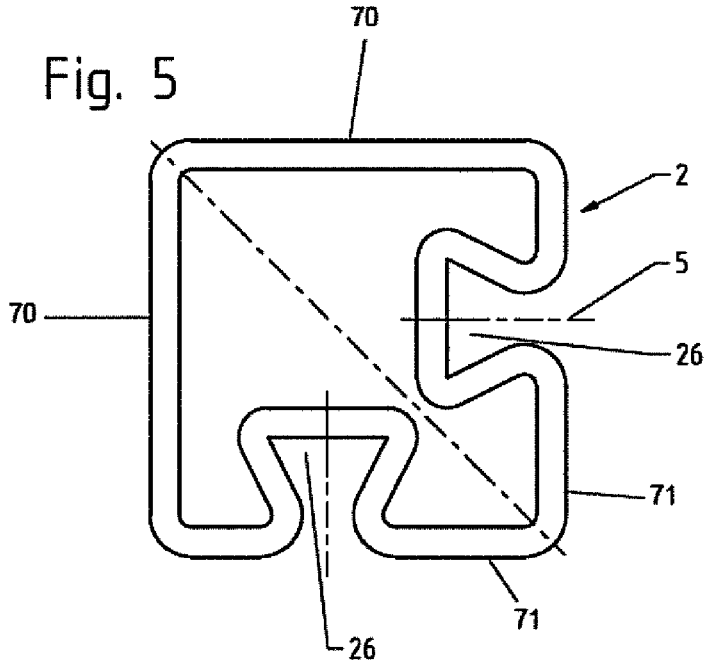
FIG. 5 is a cross-section of a post profile for a frame according to FIG. 1.

FIG. 5 is a cross-section of a post profile 2 according to the invention, which is formed as a corner profile, for a frame 1 according to FIG. 1. The post profile 2 is formed from a sheet material, preferably from a metal sheet, preferably from a steel sheet. The bent steel sheet can be processed, for example by means of a weld seam (not shown), to form the closed profile cross-section shown. In cross-section, hollow profile regions have been formed. The sheet metal is bent round or angled with corner radii in such that weaknesses in the corner regions are avoided. Additionally, welded connections for further enhancing the stability of the profile are conceivable and possible in some regions, in particular in the seam region of the profile.

The post profile 2 in cross-section has a substantially square outer contour. The two mutually perpendicular arranged sides 70 of the post profile 2 are planar disregarding the rounded edges between the sides 70. In two further mutually perpendicular arranged sides 71 of the post profile 2, slot guides 26 are formed, which, for reasons of stability, have in cross-section approximately a dovetail-shape. As indicated in FIG. 5, the slot guides 26 additionally serve for introducing and fixing connection elements 5, which are thus orientated mutually orthogonal, forming a corner.

Figure 6:
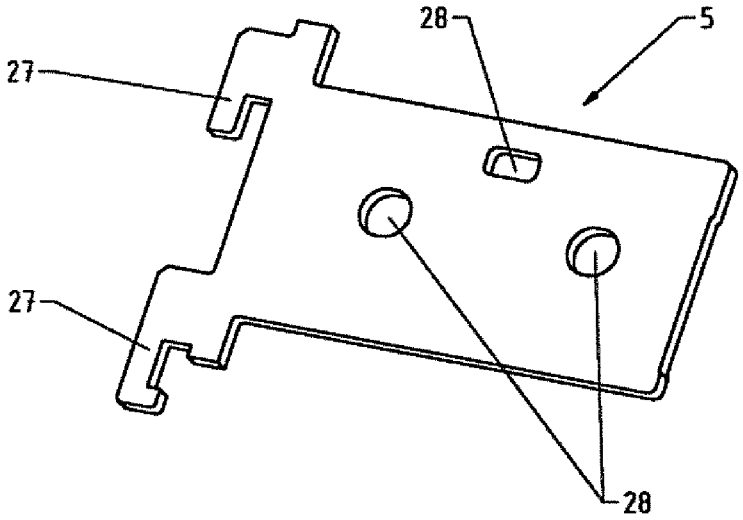
FIG. 6 is a perspective view of a connecting element for use in a post profile according to FIG. 5.

FIG. 6 is a perspective view of a connecting element 5 for use with a post profile 2 according to FIG. 5. The connecting element 5 is formed as a flat plate or strap and has, at one end, hooks 27 which can be hooked into slots (not shown) in the bottom of a slot guide 26 of a post profile 2. In addition, the connecting element 5 has a plurality of fastening holes 28, through which screws or the like can be passed as fastening means so as to connect the connecting element 5 to a crosspiece 12 or 19 of a ceiling profile 3 or a floor profile 4.

Together with the connecting element 5, the profiles 2, 3, 4 shown in the drawings form a component set or modular toolkit system which is easy to handle and which allows for a rapid, simple, precise and above all also stable construction of basic frameworks, which can support loads and are to be combined with one another to form modules for modular construction.

FIGS. 7*a* to 11*b* show different exemplary embodiments of the module connector 38. The module connectors 38 each have a first and a second connecting pin 39, 40. The module connector 38 further comprises a supporting element 41 to which the first and second connecting pin 39, 40 are mounted. The supporting element 41 is plate-shaped and has a first plate face 42 and an opposite second plate face 43. The first and the second connecting pin 39, 40 each have a cylindrical section.

In the embodiment shown in FIGS. 7*a* and 7*b*, the first connecting pin 39 is arranged on the first plate face 42, whilst the second connecting pin 40 is arranged on the second plate face 43. The first and the second connecting pin 39, 40 are arranged coaxially. The first and the second connecting pin 39, 40 may be formed in a single piece. For this purpose, the module connector 38 comprises a mandrel 44, which extends through an opening in the plate-shaped supporting element 41 and is welded to the supporting element 41. A first section of the mandrel 44 forms the first connecting pin 39, whilst a second section of the mandrel 44 forms the second connecting pin 40. Advantageously, the external diameter of the first connecting pin 39 is greater than the external diameter of the second connecting pin 40, such that the mandrel 44 has a shoulder which is braced against the supporting element 41.

The variant shown in FIGS. 7*a* and 7*b* is suitable for connecting two modular units arranged one above the other.

FIGS. 8*a* to 11*b* show variants of the module connector 38. The basic configuration of the module connector 38, which in each case comprises the supporting element 41 and at least a first and a second connecting pin 39, 40, is the same. Therefore, the description of FIGS. 7*a* and 7*b* applies accordingly to FIGS. 8*a* to 11*b*. The differences in the configuration and the significance thereof are explained in brief hereinafter.

In the embodiment shown in FIGS. 8*a* and 8*b*, the first and the second connecting pin 39, 40 are arranged side by side on the first plate face 42. The first and the second connecting pin 39, 40 have a substantially cylindrical basic shape and are arranged mutually parallel. This configuration is suitable for a construction in which the first and the second modular unit are arranged side by side. The first and the second connecting pin 39, 40 are each arranged in a hole in the supporting element 41 of the module connector 38. By welding the supporting element 41 to the first and the second connecting pin 39, 40, a stable connection can be achieved.

In the embodiment shown in FIGS. 9*a* and 9*b*, two further connecting pins 45 are provided in addition to the first and the second connecting pin 39, 40. As in the embodiment shown in FIGS. 7*a* and 7*b*, the connecting pins 39, 40 and 45 are formed by mandrels 44. The embodiment shown in FIGS. 9*a* and 9*b* is suitable for connecting four modular units, two modular units being arranged side by side in the same plane and two further modular units being arranged on top of the lower modular units in a further plane.

The embodiment shown in FIGS. 10*a* and 10*b* corresponds to that of FIGS. 9*a* and 9*b*, but in this case a total of eight connecting pins are provided, which are formed by four mandrels 44. Using the module connector 38 of FIGS. 10*a* and 10*b*, four modular units arranged side by side and four arranged above can be connected simultaneously.

The embodiment shown in FIGS. 11*a* and 11*b* is similar to that of FIGS. 8*a* and 8*b*. Four connecting pins are provided on the first plate face 42, and allow for the connection of four modular units arranged side by side.

As indicated in FIGS. 7*a* to 11*b* the first, the second and if applicable, the further connecting pins 39, 40, 45 each have a hole 46. In the embodiments shown, the hole 46 extends perpendicular to a longitudinal axis of the connecting pin 39, 40 or 45. A locking means, such as a locking pin or a locking screw can be inserted into hole 46. However, the modular system may also be used without a locking pin. The described embodiments of the module connector 38 allow for a reliable connection of the modular units even without locking means. In the case of particular strain, the connecting means may additionally be introduced so as to secure the connecting pins 39, 40, 45 in the respective pin holding fixtures of the post profile 2 and the further post profile 2 (cf. also FIG. 16).

FIG. 12 is a schematic cross-section of a part of four modular units 50, 50', 50", 50'". Two of those modular units 50", 50'" are arranged in an upper plane. These may for example form the first storey of a building. Two further modular units 50, 50' are arranged in a lower plane, and may for example form the ground storey of a building. FIG. 12 shows an upper section of the modular units 50, 50' arranged in the lower storey and a lower section of the modular units 50", 50'" arranged in the upper storey.

According to this embodiment each of the modular units 50, 50', 50", 50'" has a schematically shown post profile 2 at each of the corners. The post profiles 2 of the modular units 50 and 50' or 50" and 50'" positioned side by side are arranged such that they do not touch one another. Instead, an interstice (cf. also FIG. 13) is provided between the post profiles 2 (cf. also FIG. 13). The post profiles 2 have a configuration as shown in FIGS. 2 and 5.

The post profiles 2 of a modular unit are connected to one other at their upper ends by ceiling profiles 3 shown in FIG. 3 (cf. schematic drawing in FIG. 13). At their lower ends, the post profiles 2 of each modular unit are connected to one another by the floor profiles 4 shown in FIG. 4. In each case, the connection between the ceiling profiles 3 and the post profiles 2 is provided via the connecting elements 5 shown in FIG. 6, which are arranged in the slot guides 26 of the post profile 2. Accordingly, the modular units 50, 50', 50", 50'" each have a basic framework corresponding to the type shown in FIG. 2.

It can further be seen from FIG. 12 that the modular units 50, 50' each have a ceiling 51. As is shown by way of example for the modular unit 50', the ceiling 51 comprises support elements formed as dry-construction profiles 6. The embodiment shown exhibits C-profiles. A planking is provided comprising building boards 15, 16 which are arranged on both sides of the dry-construction profiles 6 and connected thereto via fastening means (not shown). The dry-construction profiles 6 are connected by a first end to a first ceiling profile 3 and by a second end to a further ceiling profile 3 (cf. also the basic framework shown in FIG. 2). An insulant 14 is arranged between the building boards 15, 16. The ceiling 51 is doubly planked on the room side.

The post profiles 2 of the two upper modular units 50" and 50'" are arranged exactly above the post profiles 2 of the lower modular units 50, 50'. The post profiles 2 of the upper modular units 50", 50'" are thus aligned with the post profiles 2 of the lower modular units 50, 50'.

The four modular units 50, 50', 50", 50'" may be formed identically or differently.

According to the embodiment shown in FIG. 12, the four post profiles 2 are interconnected using a module connector 38, which is configured as in FIGS. 9*a* and 9*b*. Two connecting pins 40, 45 of the module connector 38 extend in pin holding fixtures 55 provided at the upper end of the post profiles 2 of the lower module units. Two further connecting pins 39, 45 extend in pin holding fixtures 55 arranged at the lower end of the upper post profiles 2. The pin holding fixtures 55 for the connecting pins 40, 45 of the module connector 38 are shown in the plan view of FIG. 13.

FIG. 12 further shows that a sound insulation element 52 is joined to the module connectors 38. Meanwhile, FIG. 12 indicates that the sound insulation element 52 forms a covering for the connecting pins 40, 45 pointing downwards from the supporting element 41. The covering in this case has cylindrical sections for receiving the connecting pins 40, 45. In addition, the sound insulation element 52 has a plate-shaped section 53, which is arranged between the upper end of the lower post profile 2 and the plate-shaped supporting element 41. In this way, direct metal contact between the post profiles 2 arranged above one another and between the post profiles 2 arranged side by side is prevented. It was mentioned above that the connecting pins 40 on the second plate face 43 of the module connector 38 have a smaller diameter than the connecting pins 39 on the first plate face 42 (cf. FIGS. 7*a* to 11*b*). The cylindrical sections of the sound insulation element 38 form a covering for the connecting pin 40 having a smaller diameter on the second plate face 43. In this case, the external diameter of the cylindrical section in the region of the connecting pin 40 corresponds to the external diameter of the larger connecting pin 39. Thus, as a result of matching dimensions, the connecting pins 40 on the second plate face 43, comprising the covering, can be inserted into the pin holding fixture 55 with just as little play as the connecting pins 39 on the first plate face 42. The post profile can thus be used with pin holding fixtures 55 of a uniform size for connection to connecting pins both on the first and on the second plate face 42, 43.

The modular units 50, 50', 50", 50'" each have vertically arranged walls 47. FIG. 12 shows the inner wall configuration between two mutually adjacent modular units. According to this embodiment, the walls comprise a double planking with plasterboards.

FIG. 12 further shows the configuration of the floors 48 of the modular units 50" and 50'". The modular units 50, 50' may have correspondingly formed floors. The floor 48 has support elements in the form of C-shaped dry-construction profiles 8. The planking of the floor comprises the layers 23, 24 and 25. In the embodiment shown, the layer 24 is made of a board-shaped dry screed. The layer 25 is a floor covering. The layer 23 is a footfall sound insulation and may for example be a highly compressed rock wool. The dry screed (layer 24) may be formed by gypsum fibre boards. In the embodiment shown, building boards 21 are arranged below the layer 23 and are positioned against the support elements 8. The floor 48 further has building boards 22 arranged on the lower face of the support elements 8. The floor 48 also has insulation material 14 arranged between the boards 21, 22.

Further details of the modular system of FIG. 12 are shown in FIG. 13. The top view shows the two post profiles 2 of the modules 50, 50' arranged side by side. The post profiles 2 each have pin holding fixtures 55 into which the downwards-pointing connecting pins 40, 45 of the module connector 38 are inserted.

FIG. 13 also shows the cross-sectional configuration of the post profiles 2 with the two slot guides 26. The arrangement of the connecting elements 5 in the slot guides 26 joining the ceiling profiles to the post profiles 2 can also be seen in schematic, simplified form. Joining of the floor profiles and the connecting elements 5 is achieved in the same manner.

The configuration of an outer wall of a building component produced using the module units 50, 50' can further be seen from FIG. 13. Whilst the modular units 50, 50' may be prefabricated, the outer wall shown in FIG. 13 is prepared after the modular units 50, 50' have been connected to each other via the module connector 38. For the outer wall, support elements 56 are provided, which are formed as C profiles. The support elements 56 are planked with building boards 57 on both sides, an insulation material 58 being arranged between the building boards 57. In addition, an insulating layer 59, which may for example be formed from mineral wool, is arranged on the outer planking 57. In the embodiment shown, an external rendering 60 is attached to the outer face of the insulating layer 59.

FIG. 14 is a perspective drawing of the elongate ceiling profile of FIG. 3. This figure shows again the structure of the profile, comprising the first hollow profile section 34 and the second hollow profile section 35 which are interconnected via the crosspiece 12. FIG. 14 further shows that holes 61 are provided in the crosspiece 12. The holes are arranged such that they correspond to the fastening holes 28 in the connecting element 5, and allow for a screw connection.

FIG. 15 is a perspective view of the floor profile 4, which has a crosspiece 19 connecting the first and the second hollow profile section 36, 37. The crosspiece 19 has holes 61, which are formed in the same way as the holes in the ceiling profile 3. Thus, also the floor profile 4 can be connected to the post profile 2 using the connecting element 5 shown in FIG. 6.

Figure 16A:
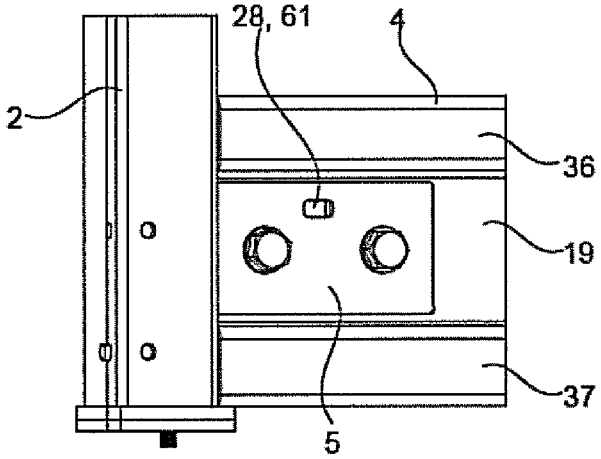

FIG. 16 is a plan view of the post profile 2 from below. FIG. 16*a* is a side view of the connection of the post profile 2 and the floor profile 4 shown in FIG. 16. This example shows how the floor profile 4 can be connected to the post profile 2 via the connecting element 5. The connection between the post profile 2 and the ceiling profile 3 may be formed in a corresponding manner. Here, the connecting element 5 is screwed to the crosspiece 19 of the floor profile 4. The connecting element 5 is arranged in the slot guide 26. The connecting element 5 is thus inserted into corresponding notches, which the post profile has on the base of the slot guide 26, using connecting means formed as hooks 27.

FIG. 16 shows by way of example the connection of just one floor profile 4 to a post profile 2 arranged in one slot guide 26. Perpendicular to the floor profile 4 shown, a further floor profile can be provided and attached to the post profile 2 via a further connecting element 5 arranged in the second slot guide.

FIG. 16 further illustrates by way of example a connecting pin 40, received in the pin holding fixture 55, of a module connector 38. To show the underlying features, further elements of the module connector are omitted from the drawing. The pin holding fixture 55 comprises sections of two sides 70 of the post profile, which are arranged at an angle, in particular perpendicular, to one another. As is shown in FIG. 16, the inner faces of the angle thus formed form the pin holding fixture 55 for the connecting pin 40. The pin holding fixture 55 additionally comprises a section 73 of the connecting element 5 (in particular of the hook), projecting into the hollow post profile 26. In this way, the pin holding fixture 55 in which the connecting pin 40 is received is formed from the hooks of the connecting element 5 and the two sides 70 of the post profile 2 which are arranged perpendicular to one another.

FIG. 16 further shows that the connecting pin 40 can be secured using a fastening means 72, which is inserted into the hole 46 of the connecting pin 40.

FIG. 17 is a perspective view of two module units 50, 50' arranged side by side, having a post profile 2 each. The module units 50, 50' each have ceiling profiles 3. These are connected to the post profiles 2 of the module units 50 and 50' via the connecting elements 5 as described above. Further, the configuration of the module connector 38 within the module is shown in FIG. 17. The module connector 38 is formed as shown in FIGS. 9*a* and 9*b*. The two upwards-pointing connecting pins 39, 45 can also be seen in FIG. 17, via which two more module units (not shown) arranged above can be connected to one another and to the two module units 50, 50'. The connecting pins 40, 45 pointing downwards from the supporting element 41 of the module connector 38 are received in the corresponding pin holding fixtures 55 of the two post profiles 2.

It can further be seen from FIG. 17 that the module connector 38 has a sound insulation element 52, which is arranged below the supporting element 41.

The invention claimed is:

1. A modular system comprising:

a. at least a first hollow post profile with a plurality of sides comprising a first side and a second side oriented along a common edge and formed at an angle relative to one another, at least a first ceiling profile and at least a first floor profile, for a basic framework of a first modular unit;

b. at least a second hollow post profile with a plurality of sides comprising a first side and a second side oriented along a common edge and formed at an angle relative to one another, at least a second ceiling profile and at least a second floor profile, for a basic framework of a second modular unit;

c. a module connector for connecting the first and second modular units, the module connector has a first connecting pin for insertion into the first hollow post profile, a second connecting pin for insertion into the second hollow post profile, and a supporting element on which the first and the second connecting pins are arranged;

d. a first pin holder to engage the first connecting pin wherein the first pin holder is defined by the first and second sides of the first hollow post profile; and e. a second pin holder to engage the second connecting pin wherein the second pin holder is defined by the first and second sides of the second hollow post profile.

2. The modular system of claim 1, wherein the first hollow post profile has an elongate length and further comprises a third side having a first slot guide extending along the elongate length of the first hollow post profile, and wherein the second hollow post profile has an elongate length and further comprises a third side having a second slot guide extending along the elongate length of the second hollow post profile.

3. The modular system of claim 2, further comprising:

f. a first connecting element having a first section attached to either the first ceiling profile or the first floor profile and a second section connected to and extending through the first slot guide of the first hollow post profile; and g. a second connecting element having a first section attached to either the second ceiling profile or the second floor profile and a second section connected to and extending through the second slot guide of the second hollow post profile.

4. The modular system of claim 3, wherein the first slot guide and the second guide slot are dovetail shaped.

5. A modular system for creating a structure, comprising at least a first hollow post profile with a first and second side oriented along a common edge and formed at an angle relative to one another and a third side having a first internally facing slot guide, at least a first ceiling profile and at least a first floor profile defining a basic framework of a first modular unit, at least a second hollow post profile with a first and second side oriented along a common edge and formed at an angle relative to one another and a third side having a second internally facing slot guide, at least a second ceiling profile and at least a second floor profile defining a basic framework of a second modular unit, and a module connector for connecting the first and the second modular units, the module connector has a first connecting pin for insertion into the first hollow post profile, a second connecting pin for insertion into the second hollow post profile, and a supporting element on which the first and the second connecting pins are arranged, and a first pin holding fixture defined by the first and second sides of the first hollow post profile to engage the first connecting pin, and a second pin holding fixture defined by the first and second sides of the second hollow post profile to engage the second connecting pin.

6. A modular system according to claim 5, wherein the module connector and the first and the second pin holding fixtures are disposed such that an interstice is formed between the first post profile and the second post profile when the first modular unit is arranged adjacent to the second modular unit.

7. A modular system according to claim 5, wherein the module connector has a mandrel which extends through an opening in the supporting element and of which a first section forms the first connecting pin and a second section forms the second connecting pin.

8. A modular system according to claim 5, wherein the first and/or the second connecting pin have a hole which extends at an angle to a longitudinal axis of the first or second connecting pin.

9. A modular system according to claim 5, wherein the first post profile, the first ceiling profile and the first floor profile each have differently configured cross-sections.

10. A modular system according to claim 5, wherein the first slot guide extends in the longitudinal direction of the first hollow post profile.

11. The modular system according to claim 10, wherein the first hollow post profile comprises a fourth side having a second internally facing slot guide, and wherein the third and fourth sides are oriented along a common edge and formed at an angle relative to one another.

12. A modular system according to claim 5, wherein the first modular unit and/or the second modular unit comprise at least one of at least one wall, at least one ceiling and at least one floor.

13. A structure comprising the modular system according to claim 5, wherein the first modular unit and the second modular unit are connected using the module connector in that the first connecting pin is inserted into the first pin holding fixture and the second connecting pin is inserted into the second pin holding fixture.

14. The modular system according to claim 5, wherein the first and second connecting pins are shaped such that the first connecting pin can be inserted into the first pin holding fixture and the second connecting pin can be inserted into the second pin holding fixture.

15. The modular system according to claim 5, further comprising at least a first connecting element having a first section attached to the first ceiling profile and a second section connected to and extending through the first slot guide of the first hollow post profile and a second connecting element having a first section attached to the second ceiling profile and a second section connected to and extending through the second slot guide of the second hollow post profile, and wherein the first pin holding fixture further comprises the second section of the first connecting element, and the second pin holding fixture further comprises the second section of the second connecting element; and, at least a third connecting element having a first section attached to the first floor profile and a second section connected to and extending through the first slot guide of the first hollow post profile and a fourth connecting element having a first section attached to the second floor profile and a second section connected to and extending through the second slot guide of the second hollow post profile, and wherein the first pin holding fixture further comprises the second section of the third connecting element, and the second pin holding fixture further comprises the second section of the fourth connecting element.

16. The modular system according to claim 15, wherein the second section of the first and second connecting elements comprise at least one hook, and the first and second slot guides comprise at least one notch for positive connection to at least one hook of the first and second connecting elements.

17. A modular system comprising at least a first hollow post profile with a first side and a second side oriented along a common edge and formed at an angle relative to one another and a third side having a first slot guide, at least a first ceiling profile, at least a first floor profile and a first connecting element having a first section attached to either the first ceiling profile or the first floor profile and a second section connected to and extending through the first slot guide of the third side of the first hollow post profile, for a basic framework of a first modular unit, at least a second hollow post profile with a first side and a second side oriented along a common edge and formed at an angle relative to one another and a third side having a second slot guide, at least a second ceiling profile and at least a second floor profile, a second connecting element having a first section attached to either the second ceiling profile or the second floor profile and a second section connected to and extending through the second slot guide of the third side of the second hollow post profile, for a basic framework of a second modular unit, and a module connector for connecting the first and the second modular units, the module connector has a first connecting pin for insertion into the first hollow post profile, a second connecting pin for insertion into the second hollow post profile, and a supporting element on which the first and the second connecting pins are arranged, and wherein the first side and second side of the first hollow post profile and the second section of the first connecting element define a first pin holding fixture to engage the first connecting pin and the first side and the second side of the second hollow post profile and the second section of the second connecting element define a second pin holding fixture to engage the second connecting pin.

18. The modular system of claim 17, wherein the first hollow post profile has an elongate length and the first slot guide extends the entire length of the first hollow profile.

19. The modular system of claim 17, wherein the first slot guide and the second guide slot are dovetail shaped.

20. The modular system of claim 17, wherein the at least a first hollow post profile further comprises a fourth wall having a third slot guide and the first and third slot guides have opening directions orientated substantially mutually perpendicular to one another.

21. The modular system of claim 17, wherein the second section of the first and second connecting elements comprise at least one hook, and the first and second slot guides comprise at least one notch for positive connection to at least one hook of the first and second connecting elements.

* * * * *